United States Patent [19]

Gorton et al.

[11] 4,045,982

[45] Sept. 6, 1977

[54] COMPACT PORTABLE LOCK FOR SLIDING WINDOWS AND DOORS

[75] Inventors: Howard Byron Gorton, San Gabriel; Richard B. Lyons, Huntington Beach, both of Calif.

[73] Assignee: Ajax Hardware Corporation, City of Industry, Calif.

[21] Appl. No.: 754,186

[22] Filed: Dec. 27, 1976

[51] Int. Cl.[2] ..... E05C 65/08

[52] U.S. Cl. ..... 70/90; 49/449; 70/100; 292/153; 292/175; 292/288; 292/DIG. 46

[58] Field of Search ..... 70/14, 90, 95, 96, 97, 70/98, 99, 100, 102, 104, 106, 131, 142; 292/145, 150, 153, 175, 288, 258, DIG. 46, DIG. 47; 49/449, 450, 451

[56] References Cited

U.S. PATENT DOCUMENTS

| | | | |
|---|---|---|---|
| 387,372 | 8/1888 | Smith | 70/97 |
| 559,982 | 5/1896 | Madison | 70/90 |
| 570,503 | 11/1896 | Robertson | 292/150 X |
| 710,189 | 9/1902 | Forbes | 70/104 X |
| 1,744,988 | 1/1930 | Shaw | 70/104 |
| 3,428,349 | 2/1969 | Shelton | 292/288 |
| 3,756,641 | 9/1973 | Dugan | 292/DIG. 46 X |
| 3,768,847 | 10/1973 | Buck et al. | 292/DIG. 46 X |
| 3,877,261 | 4/1975 | Robins | 70/90 |

FOREIGN PATENT DOCUMENTS

| | | | |
|---|---|---|---|
| 11,821 | 7/1891 | United Kingdom | 292/175 |
| 27,250 | 11/1911 | United Kingdom | 292/153 |

*Primary Examiner*—Roy D. Frazier
*Assistant Examiner*—Thomas J. Holko
*Attorney, Agent, or Firm*—Dallett Hoopes

[57] ABSTRACT

A compact portable lock has a locking plunger angled to fit into a pre-drilled opening in a door or window rail permitting a lock with very minimal clearance requirements with regard to the adjacent frame. A window in the bottom cover plate of the lock accommodates a flange on the lock plunger and defines the travel of the plunger.

3 Claims, 6 Drawing Figures

COMPACT PORTABLE LOCK FOR SLIDING WINDOWS AND DOORS

BACKGROUND OF THE INVENTION

1. Field of the Invention

This invention relates to a compact portable lock for sliding windows and doors. More specifically, this invention relates to such a lock including a plunger adapted to penetrate a pre-drilled hole in a window or door rail and to hold the lock firmly on said rail blocking further opening of the window or door. The lock may be operated by manipulation of the plunger by hand, and the plunger may be locked in an engaged position by a key lock incorporated in the structure.

2. Description of the Prior Art

The prior art is replete with many portable locks of the key-operated variety and including a number which incorporate reciprocable plungers adapted to be engaged in a hole in a track on which a sliding door or window travels. An example is found in the old U.S. Pat. No. 559,982 which issued May 12, 1896 to Madison. However, the prior devices were not sufficiently compact for use for which the present lock is intended; namely, the securement of the lock to the stationary rail or track of a modern sliding window or door.

SUMMARY OF THE INVENTION

The present invention includes a lock housing being an inverted box-shaped element having a pair of upward aligned slots respectively on opposite sidewalls thereof. Within the housing a plunger is mounted at an inclined angle and adapted to intercept the door or window rail which is received into the slots. A cover plate on the bottom of the housing contains a window which receives a portion of an annular flange on the plunger and defines the limits of its travel. A key cylinder is mounted in a cylindrical hollow upward projection on the housing.

BRIEF DESCRIPTION OF THE DRAWINGS

Other features and objects of the invention will be apparent from a review of the following specification and reference to the accompanying drawings all of which disclose a non-limiting form of the invention. In the drawings.

DESCRIPTION OF THE PREFERRED EMBODIMENT

Figure 1:
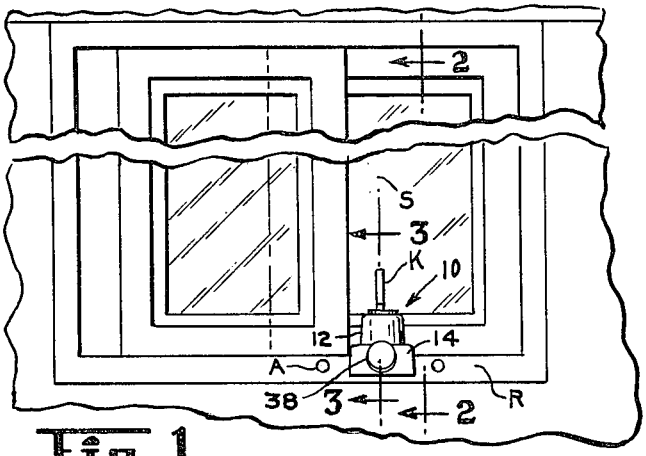
FIG. 1 is a front view of a lock embodying the invention as installed on the rail of a horizontal sliding window, the window being interrupted for ease of illustration.
Figure 2:
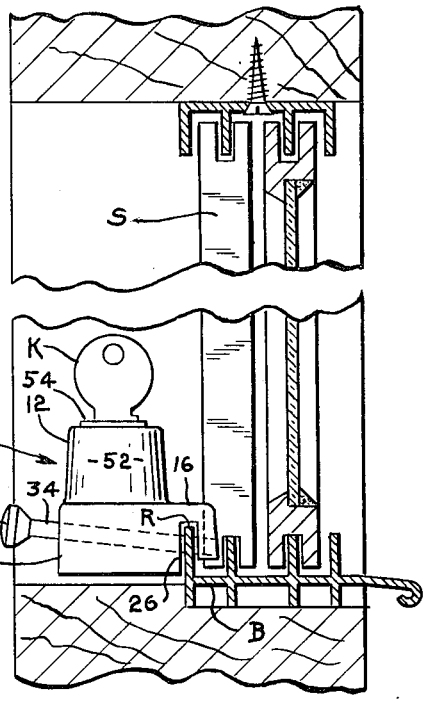
FIG. 2 is an enlarged sectional view taken on the line 2—2 of FIG. 1 showing how the lock engages the rail of the window and showing in phantom lines a portion of the plunger inside the lock housing.

Referring more specifically to the drawings, a lock embodying the invention is designated 10 in FIG. 1. It comprises a housing 12 (FIG. 3) including an inverted open box-shaped base 14 having a top 16 and sidewalls 18, 20, 22, and 24.

Two opposite sidewalls are formed with a line of upwardly extending slots 26 adjacent one of the sidewalls 18. The sidewalls 20, 22 and top 16 present a downwardly extending flange 28 parallel to the sidewall 18. The flange 28 and the opposite sidewall 24 are apertured as at 30 and 32 to provide an inclined passage through the inside of the box for a plunger 34.

Figure 3:
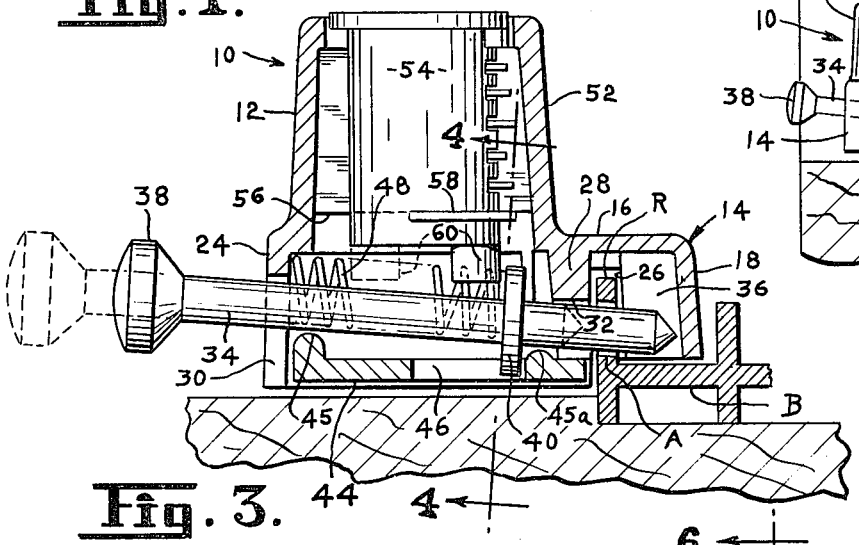
FIG. 3 is an enlarged sectional view taken on the line 3—3 of FIG. 1 and showing in dotted lines an alternate position of the plunger.
Figure 4:
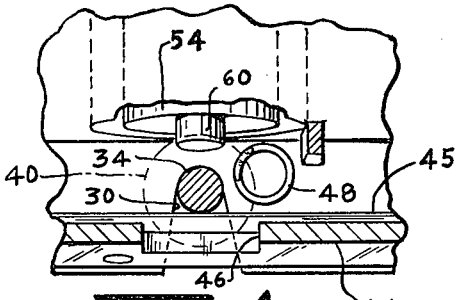
FIG. 4 is a fragmentary sectional view taken on the line 4—4 of FIG. 3.

The top 16 and the sidewall 18 carry a pair of spaced inward fins 36 which provide between them a space to reciprocally receive the inner end of the plunger 34. The outer end of the plunger 34 is provided with an operating head 38. As shown in FIG. 3, the plunger 34 is formed with an annular flange 40 intermediate the fin 28 and the sidewall 24.

The top wall 16 is formed with a plurality of downward shouldered bosses 42 in opposite sides of the plunger 34. These bosses are received into apertures in a cover plate 44 and are then headed over as shown to hold the cover plate 44 against the bottom of the base 14. As shown, the cover plate 44 is formed with upward transverse ribs **45, 45*a* of different height to support the plunger in inclined position, as shown. The plate is also provided with a window 46, and it is in this window (FIG. 3) that the flange 40 operates, the opposite margins of the window 46 defining the opposite limit of travel of the annular flange 40 and therefore the plunger 34**.

A coil or spiral spring 48 is disposed in the base 14 and is held compressively between the sidewall 24 and the flange 40, urging the plunger 34 in its inward position as shown in solid lines in FIG. 3.

It will be noted that the downward incline of the plunger 34 (FIG. 3) makes it possible for the unit to accommodate a very shallow rail and require very little clearance room with respect to the adjacent frame. The present lock also requires minimum clearance between the top of the rail R and the base wall B of the rail. It should be noted that the bottom surface of the base 14 is stepped, being higher on the side of the slots 26 more proximate the sidewall 18 than on the other side of the slots. Additionally, the window 46 permits the flange 40 to have its lowermost portion level even with the bottom surface of the housing 12.

Extending up from the base 14 is a hollow cylindrical projection 52 which is suitably apertured at its upper end to receive a key cylinder 54. Preferably, there is inward shoulder 56 inside the projection 52 adjacent the lower end of the cylinder 54. A suitable spring clip-type retainer 58 may engage a groove in the cylinder to hold the cylinder in position in the housing.

When it is needed to replace the cylinder 54, the retainer 58 may be moved away by manipulation through the window 46 by a special tool.

Figure 5:
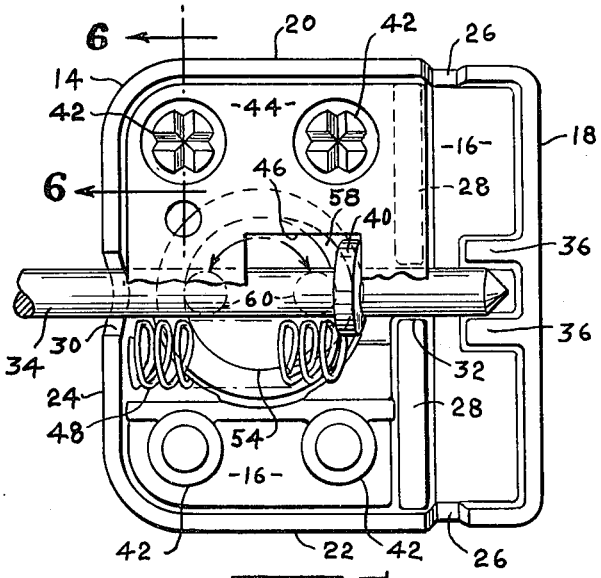
FIG. 5 is a bottom view of a lock embodying the invention and showing the cover plate partly broken away to expose a portion of the internal structure. Additionally, the plunger is shortened for ease of illustration.
Figure 6:
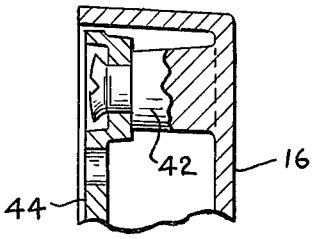
FIG. 6 is a fragmentary sectional view taken on the line 6—6 of FIG. 5.

The lower end of the cylinder 54 is formed with an offset stop 60. The stop may assume alternately the positions shown in FIGS. 3 and 5 (note direction arrows in FIG. 5). In the rightward position of FIG. 3, the stop blocks the retraction of the plunger as the annular flange 40 engages it. In the dotted line position to the left (FIG. 3), the stop does not impede movement of the plunger.

In operation, the lock is set down over rail R, the slots 26 of the housing receiving the rail R which has been pre-apertured as desired at A. The plunger is then withdrawn and released so that it extends inward and through the opening A. With the plunger in this position, the lock 10 is immovable along the rail and provides an absolute stop for the window sash S. If desired, the lock may be removed by drawing out the plunger 34 from the opening A and lifting the unit from the rail. If it is desired to have the lock 10 installed in a way which makes it unremovable except with a key, the lock is installed on the rail as described with the plunger in opening A. The key K in the cylinder 54 may then be rotated to move the stop 60 to the position shown in FIG. 3 wherein it prevents the withdrawal of the plunger by blocking movement of the flange 40. With the key K removed, the unit is permanently, in the absence of a key, in place as shown. With a key, the cylinder 54 may be rotated to move the stop 60 to the dotted line position shown in FIG. 3 permitting withdrawal of the plunger away from the opening A and the complete removal of the lock.

Important features of the invention include the windowed cover plate 44 and the inclined plunger 34. These features together permit the arrangement of the plunger 34 in a very low position on the lock 10 so that very little clearance is needed for the lock on the inside of the window or door adjacent the frame.

An embodiment of the invention having been described, it should be understood that the invention is not so limited but may be described in the following claim language or equivalents thereof.

We claim:

1. A compact lock adapted to be attached to the rail of a sliding door or window to limit the movement thereof, the lock comprising a housing having an inverted rectangular box-shaped base with a top wall and sidewalls and a hollow cylindrical projection upstanding from the top wall and offset from the center of the top wall away from one of the sidewalls thereof, a circular opening in the top wall of the projection, the housing having aligned upwardly extending slots formed in opposite sidewalls adjacent the said sidewall and a pair of closely spaced fins extending inward from a central portion of the said sidewall on the underside of the base, the base having a downward flange parallel to the said sidewall and spaced inward from said slots, the flange and the sidewall opposite the said sidewall having aligned openings defining a passage transverse of the housing inclined downwardly toward the lower portion of the said sidewall and terminating in the space between the said pair of fins; a plunger disposed in the passage and extending outward of the base and terminating in an operating portion, the plunger having an outward annular flange disposed on the plunger intermediate said flange and the sidewall opposite the said sidewall, the circular opening in the top wall of the projection receiving a key-operated cylinder extending downwardly in the projection and having an operating stop at the lower end thereof offset from the axis of said cylinder, the cylinder being adapted when turned with a key to move from a locking position in which the stop blocks the annular flange and therefore the plunger from movement away from the spaced fins and therefore holds the plunger in locked position, and a second or unlocked position in which the stop does not interfere with the movement of the plunger, and a cover plate secured to the base on the underside thereof, the cover plate having a rectangular window adapted to receive the annular flange, the margins of the window defining at least one limit of travel of the annular flange and therefore the plunger; whereby with the plunger retracted, the aligned slots of the lock may receive the rail of a door or window and the plunger may be released to pass through a predrilled opening in the rail to the extended position, and the lock may be turned to the locked position to secure the lock in such attachment.

2. A compact lock as claimed in claim 1 wherein a spiral spring is disposed in the box-shaped base in compression between the flange and the sidewall of the box opposite the said sidewall, whereby the plunger is urged toward the closed condition.

3. A compact lock as claimed in claim 1 wherein the margins of the window define the opposite limits of travel of the annular flange and therefore the plunger.

* * * * *